United States Patent [19]

Moreau et al.

[11] 4,315,385

[45] Feb. 16, 1982

[54] HIGH-SAFETY CONTAINER

[75] Inventors: Philippe J. Moreau, Neuilly-sur-Seine; Jacques G. A. Monsterleet, Marly-le-Roi, both of France

[73] Assignee: Campenon Bernard Cetra & Constructions Metalliques, Neuilly-sur-Seine, France

[21] Appl. No.: 14,006

[22] Filed: Feb. 21, 1979

[30] Foreign Application Priority Data

Mar. 1, 1978 [FR] France ..... 78 05850

[51] Int. Cl.[3] ..... E04B 1/32; E02D 27/00

[52] U.S. Cl. ..... 52/80; 52/167; 52/169.5; 52/169.6; 52/249

[58] Field of Search ..... 220/1 B; 52/167, 169.5, 52/169.6, 224, 249, 80

[56] References Cited

U.S. PATENT DOCUMENTS

| | | | |
|---|---|---|---|
| 625,258 | 5/1899 | Grow | 52/80 |
| 2,370,780 | 3/1945 | Crom | 52/224 X |
| 2,649,059 | 8/1953 | Mercier | 52/80 |
| 3,047,184 | 7/1962 | Van Bergen et al. | 52/80 |
| 3,499,255 | 3/1970 | Sweeney et al. | 52/263 |
| 4,015,383 | 4/1977 | Crowley | 52/224 |

FOREIGN PATENT DOCUMENTS

| | | | |
|---|---|---|---|
| 328442 | 10/1920 | Fed. Rep. of Germany | 52/249 |
| 2054962 | 5/1952 | Fed. Rep. of Germany . | |
| 684951 | 3/1930 | France . | |
| 977666 | 11/1950 | France | 52/169.6 |
| 1279141 | 11/1961 | France | 52/169.6 |
| 1315221 | 12/1962 | France | 52/80 |
| 33496 | 4/1955 | Luxembourg . | |
| 728423 | 4/1955 | United Kingdom | 52/80 |
| 525780 | 12/1976 | U.S.S.R. | 52/167 |

*Primary Examiner*—Alfred C. Perham
*Attorney, Agent, or Firm*—Neil F. Markva

[57] ABSTRACT

A high-safety container more particularly intended for dangerous products or installations. A tank includes an inner sidewall, a floor and a top which define a storage enclosure. A continuous leak-proof foundation basement includes a downwardly bulging cupola having a convex undersurface exposed throughout to external upwardly directed hydrostatic-like thrust. The tank floor is disposed above and laterally spaced from the upper concave face of the downwardly bulging cupola to define a lower ventilating gap therebetween. The pillars extend between the tank floor and the upper concave face to support the tank over the cupola. An outer wall integral with the cupola forms an upwardly projecting peripheral extension of the cupola. An annular space is defined between the outer wall and the inner side wall around the tank. A filler material disposed in the annular space contributes to the stability of the container with respect to lifting effects caused by hydrostatic thrust, even when the container is empty.

16 Claims, 7 Drawing Figures

16
18
19
2
19
17

3
2
III
III
18
17
5
5
1

HIGH-SAFETY CONTAINER

FIELD OF INVENTION

The present invention relates to enclosures, tanks or reservoirs intended for containing and protecting a variety of products or installations and hereinafter termed "containers".

BACKGROUND OF THE INVENTION

Under the pressure of public opinion and official bodies responsible for public safety, an increasingly higher level of safety is sought in connection with the storage of dangerous products in order to segregate them from the environment and protect them against external attack. Notable examples of such products are liquids such as natural gas, ammonia, vinyl chloride, hydrocarbons and the like.

Far from constituting mere storage means, the containers used to this end must now be capable of withstanding fire, sabotage (such as rocket firings) and even aircraft crashes, earthquakes and other similar forms of aggression.

It is the main object of the present invention to provide a container able to withstand these different forms of aggression. Moreover such a container must be regarded as being required not only to store products or materials but also to enclose especially dangerous or delicate installations such as nuclear reactors or chemical reactors.

SUMMARY OF THE INVENTION

The container of this invention includes a tank which rests on a continuous leak-proof foundation which leaves a gap beneath said tank and which is extended by an external containment wall that bounds, around the tank, an annular space which can be filled with a protective product such as a powdery material (sand for example) or concrete poor in cement.

The tank can be either rigidly connected to its foundation or repose thereon through the agency of supports permitting expansion.

Preferably, ventilation means are provided in said spaces notably in order to maintain a preset temperature and thereby prevent, say, the floors from freezing where liquefied gases at low temperatures are involved, prevent dangerous gases from accumulating, or enable the integrity of the foundation to be checked.

The container is preferably made of either reinforced or prestressed concrete, depending on individual cases, the strains involved and safety conditions. Such container may be of very considerable size.

BRIEF DESCRIPTION OF DRAWINGS

The description which follows with reference to the accompanying non-limitative exemplary drawings will give a clear understanding of how the invention can be carried into practice.

In the drawings.

DETAILED DESCRIPTION

Figure 1:
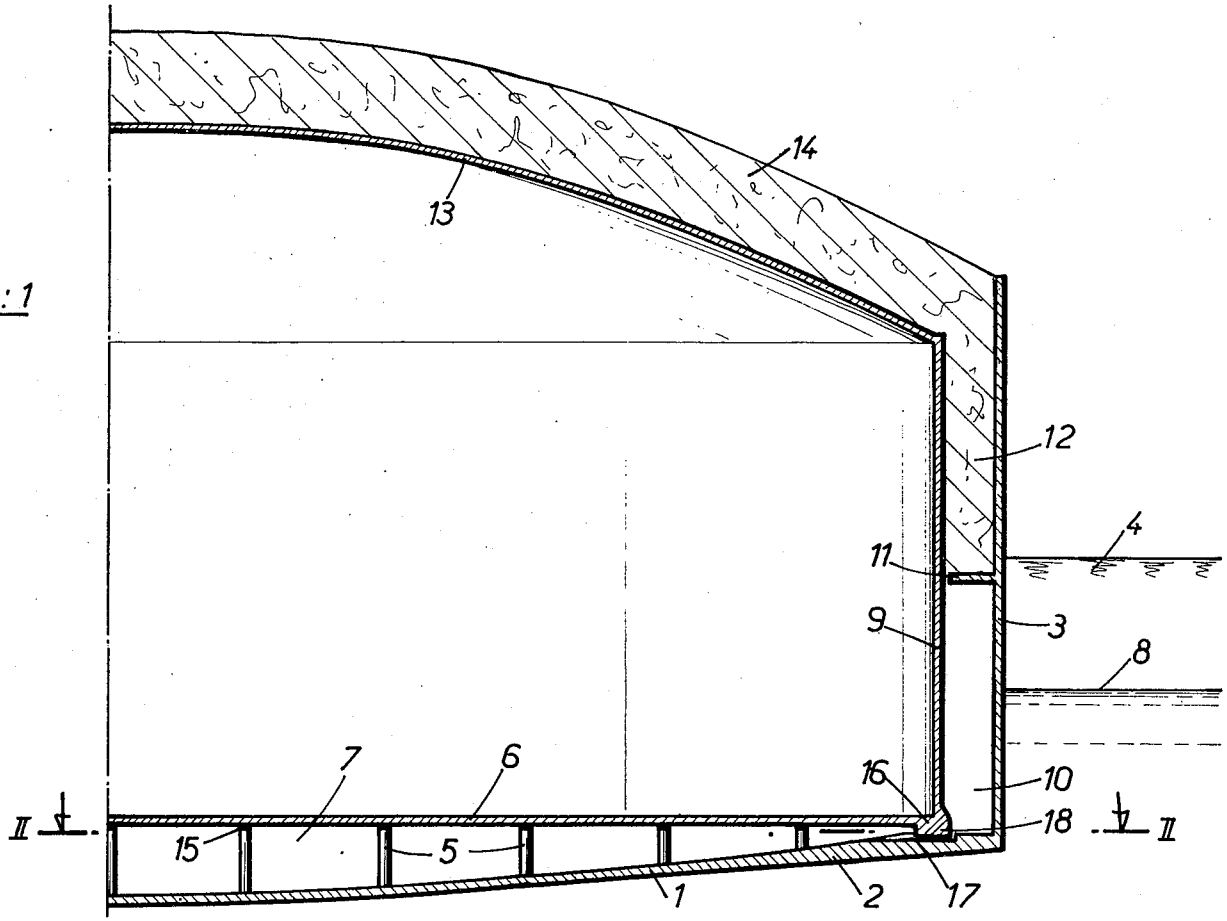
FIG. 1 is a partial schematic illustration in vertical section of a container according to this invention.

Referring first to FIGS. 1 through 4, the container shown thereon includes a foundation basement consisting of a cupola or bowl 1 having its concave side facing upwardly. As is evident as described herein, the downwardly bulging cupola 1 has its convex undersurface exposed throughout to external upwardly-directed hydrostatic-like thrust. In the present example this cupola is circular, but it is to be understood that its periphery could be otherwise shaped.

The marginal portion 2 of cupola 1 is strengthened and is connected to a vertical external or outer wall 3 which is cylindrical in the present example. The whole is buried in the ground 4 to any convenient depth.

Figures 2, 3:
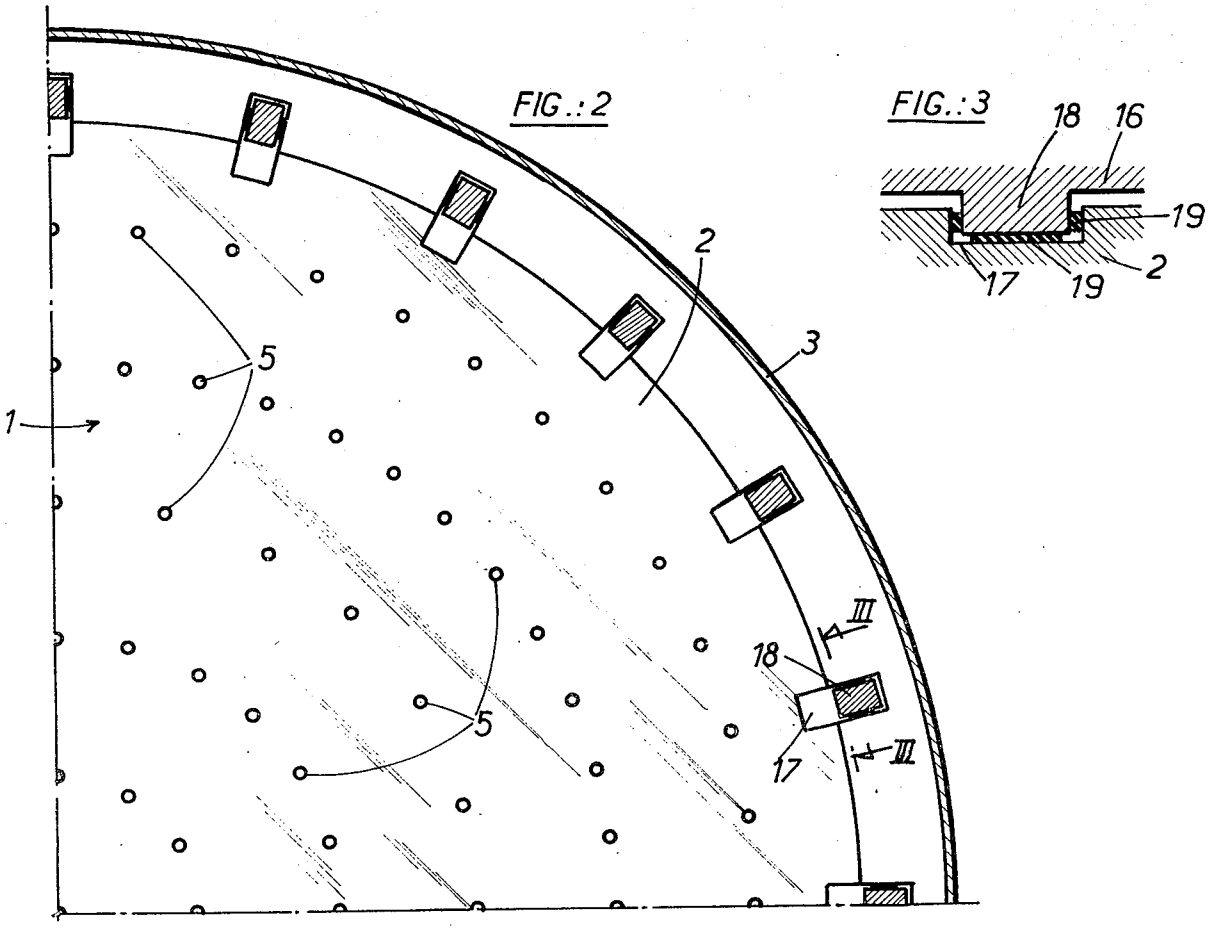
FIG. 2 is a partial sectional view through the line II—II of FIG. 1.
FIG. 3 is a detail view in section through the line III—III of FIG. 2.

Carried on cupola 1 are pillars 5 arranged in concentric circles as shown in FIG. 2 and adapted to support a possibly flat slab 6. A gap 7 is provided between the slab 6 and the cupola 1 in order to insulate the inner tank of the container against possible infiltrations of water from the water-table 8. The ingress of water would be particularly harmful if liquefied gases were stored in the container.

The slab 6 is fast with the side wall 9 of the tank, which wall is parallel to external wall 3, an annular space 10 being provided between the two walls.

The lower portion of space 10 forms an inspection and ventilation tunnel which is bounded at its top by a ceiling 11 (see FIG. 1). The space 10 can contain a filler material 12, examples being a powdery material such as sand to provide protection against external shock or projectiles, or concrete poor in cement particularly if the container is to be stranded (in which case a slight gap must be left between the concrete poor in cement and the external wall 3 to permit drainage and ventilation).

The dimensions of the space 10 and its filler material are so chosen as to ensure that the safety criteria in respect of external shocks are strictly observed and stability in respect of lifting effects caused by hydrostatic thrust is ensured even when the container is empty.

Internal wall 9 is extended by a dome 13 which, like the space 10, can receive filler material 14 that also helps to protect and ballast the installation. In order to ensure retention of such filler material, external wall 3 rises to a level higher than that of the dome springings.

If the stored products are at normal temperature there is no disadvantage in rigidly connecting the cupola and the external wall to the slab and to the internal wall; on the other hand, where relatively large differences are to be expected between the ambient temperature and the temperature inside the container, the cupola 1 and the external wall 3 must not be fast with the tank. In the latter event, it is possible to interpose, between the pillars 5 and slab 6, supports 15 similar to those which are used on bridges and permit relative shifting of structural elements and at the same time transmit large vertical loads. Such supports may be made of sintered elastomers, an example being Neoprene.

In order to prevent bodily movements of the internal tank, particularly in the event of an earthquake, keyways formed by radial indents or mortises 17 of rectangular profile are provided around marginal portion 2 (see FIGS. 1 and 2) whereby to receive tenons 18 provided beneath the slab 3.

Elastic supports 19 similar to the supports 15 are interposed horizontally and vertically between the tenons and the mortises or indents.

Obviously, the internal tank may be lined with any convenient material. If, for instance, gas transfer processes between the outside and the inside of the tank are to be avoided (ingress of air or water vapor, exit of dangerous gases), then the slab 6, the wall 9 and the dome 13 can be coated with sealing paint or lined with thin plated sheet.

Figure 4:
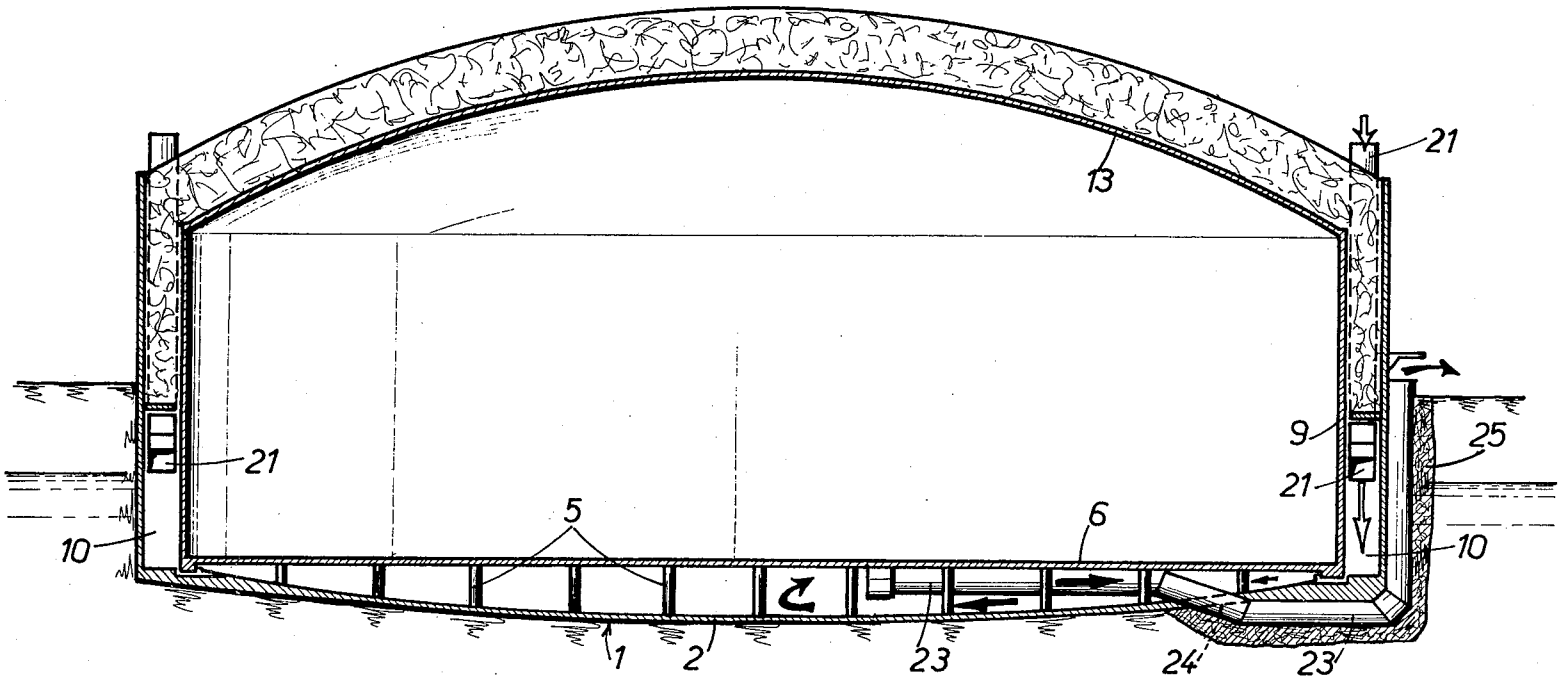
FIG. 4 is a diagrammatic vertical section showing the ventilation principle used for the container.

FIG. 4 illustrates the principle of an aerating or ventilating system with which the container could be equipped.

Air from the surrounding atmosphere is fed through ducts 21 into the tunnel 10 before flowing into the space 7 via the slits existing between keyways 17–18. It is then returned to the atmosphere through ducts 23, on which may be disposed fans and any desired detection gear. An access tunnel for inspection personnel is preferably provided along the duct 23. These ducts pass through cupola 1 via leaktight passageways 24; externally of the container they are protected by concrete sheaths 25.

Figure 5:
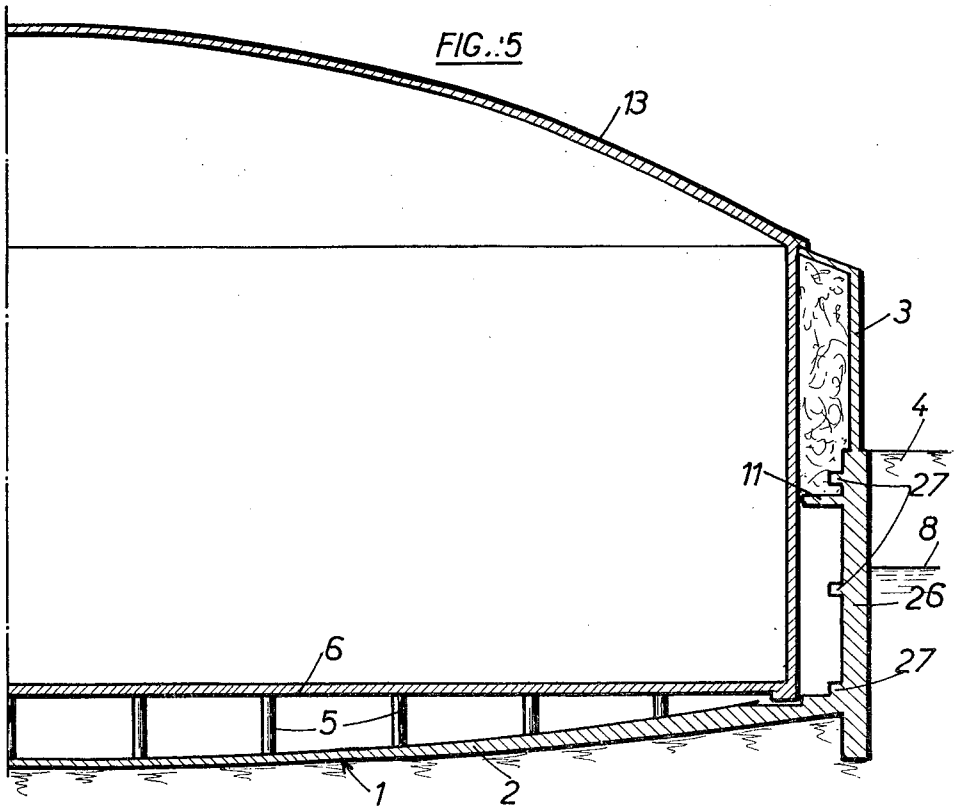
FIG. 5 is a partial vertical section taken through an alternative embodiment having an external wall molded into the ground.

In the alternative embodiment shown in FIG. 5, the lower part 26 of external wall 3 is obtained by the technique of molding it from the soil.

The following procedure may be adopted:

produce the wall by molding it from the natural soil or from a prior embankment;

produce an embankment inside the wall 26, forming stiffening rings 27 thereon at different levels;

produce the cupola 1 well sheltered from the water-table.

Alternative techniques can be adopted, for instance using planking subsequently lined with concrete for the portion 26.

Figure 6:
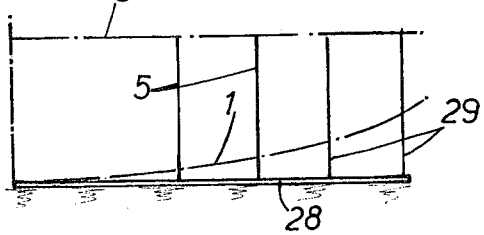
FIG. 6 is a very fragmental schematic vertical section of a second alternative embodiment having a lower supporting slab.

If the container is to be stranded, a slab 28 can be provided beneath cupola 1 as shown in FIG. 6. This slab is joined to the cupola by posts 29 and enables stranding to be effected on a seating provided under water.

Figure 7:
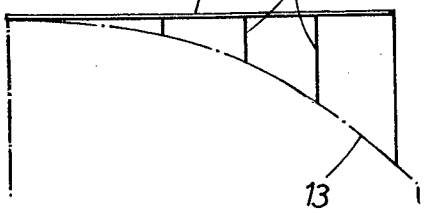
FIG. 7 is a corresponding view of yet another alternative embodiment employing upper plate elements.

As shown in FIG. 7, plate elements 30 can alternatively be mounted on dome 13 by means of posts 31 to enable a variety of gear to be installed.

It goes without saying that many changes and substitutions may be made in the exemplary embodiments hereinbefore described without departing from the scope of the invention.

We claim:

1. A high-safety container for housing dangerous products or installations, said container comprising a combination of:

(a) a tank including an inner side wall, a floor and a top which define a storage enclosure, (b) a continuous leak-proof foundation basement including a downwardly bulging cupola having an upper concave face and a convex undersurface exposed throughout to external upwardly-directed hydrostatic-like thrust, (c) said tank floor being disposed above and spaced from the upper concave face of said downwardly bulging cupola to define a lower ventilating gap therebetween, (d) pillar means extending between the tank floor and said upper concave face to support said tank over the cupola, and (e) an outer wall integral with said cupola to form an upwardly projecting peripheral extension of the cupola, (f) said outer wall and said inner sidewall being laterally spaced to form an annular space around said tank.

2. A container as claimed in claim 1, wherein said annular space contains a filler material.

3. A container as claimed in claim 1, wherein the tank, the cupola and the external wall are rigidly interconnected.

4. A container as claimed in claim 1, wherein said pillar means includes supports which permit expansion, key means at the lower edge of said tank and the edge of said cupola prevent bodily motion of said tank with respect to said cupola.

5. A container as claimed in claim 4, wherein the key means include mortises and tenons engaging thereinto, elastic support means being interposed between said tenons and said mortises.

6. A container as claimed in claim 1, wherein ventilation ducts are arranged to connect the spaces between the tank, the cupola and the external wall to the surrounding atmosphere.

7. A container as claimed in claim 1, wherein the tank has a dome that can be covered with lining means which also contribute to the protection and ballasting of the container.

8. A container as claimed in claim 7, wherein the dome is surmounted by plate elements for permitting installation of a variety of gear.

9. A container as claimed in claim 1, wherein a supporting slab is provided to permit stranding of the container on a seating provided under water.

10. A container as claimed in claim 1, wherein the external wall is constructed by molding into the soil.

11. A container as claimed in claim 1, wherein the inner sidewall and the floor of the tank are integrally formed, and the outer lower edge of the tank rests at a marginal edge portion of the upper concave face of the cupola, mortises are formed on one of the said edges and tenons are formed on the other of said edges to define a keyed structure which prevents motion of the tank with respect to the cupola.

12. A container as claimed in claim 11, wherein said pillar means includes expansion supports which are effective to permit relative vertical movement between the tank floor and the cupola.

13. A container as claimed in claim 1, wherein the inner sidewall and the floor of the tank are integrally formed, the upwardly projecting peripheral extension of the cupola extends upwardly above the height of the inner sidewall of the tank, and filler material is disposed in the annular space and held in place over the top of the tank by the upwardly projecting peripheral extension.

14. A container as claimed in claim 13, wherein means disposed in the annular space contains the filler material in the upper portion of the annular space and defines a ventilation zone in the lower portion of the annular space.

15. A container as claimed in claim 13, wherein the filler material is cement poor concrete.

16. A container as claimed in claim 13, wherein the top of the tank is dome shaped.

* * * * *